US006908364B2

(12) United States Patent
Back et al.

(10) Patent No.: US 6,908,364 B2
(45) Date of Patent: Jun. 21, 2005

(54) METHOD AND APPARATUS FOR PROBE TIP CLEANING AND SHAPING PAD

(75) Inventors: Gerald W. Back, Gilbert, AZ (US); Son Dang, Tempe, AZ (US); Bahadir Tunaboylu, Chandler, AZ (US)

(73) Assignee: Kulicke & Soffa Industries, Inc., Willow Grove, PA (US)

( * ) Notice: Subject to any disclaimer, the term of this patent is extended or adjusted under 35 U.S.C. 154(b) by 350 days.

(21) Appl. No.: 09/921,327

(22) Filed: Aug. 2, 2001

(65) Prior Publication Data

US 2003/0027496 A1 Feb. 6, 2003

(51) Int. Cl.[7] ..... B24D 11/00
(52) U.S. Cl. ..... 451/36; 451/533
(58) Field of Search ..... 451/36, 59, 533, 451/534, 537; 15/218, 218.1, 220.4, 229.11, 229.12, 244.1, 244.4

(56) References Cited

U.S. PATENT DOCUMENTS

| | | | | |
|---|---|---|---|---|
| 3,148,404 A | * | 9/1964 | Jensen | 15/104.93 |
| 5,652,428 A | | 7/1997 | Nishioka et al. | |
| 5,778,485 A | | 7/1998 | Sano et al. | |
| 5,814,158 A | | 9/1998 | Hollander et al. | |
| 5,961,728 A | | 10/1999 | Kiser et al. | |
| 5,968,282 A | | 10/1999 | Yamasaka | |
| 5,998,986 A | | 12/1999 | Ido | |
| 6,013,169 A | | 1/2000 | Okubo et al. | |
| 6,019,663 A | | 2/2000 | Angell et al. | |
| 6,056,627 A | | 5/2000 | Mizuta | |
| 6,130,104 A | * | 10/2000 | Yamasaka | 438/14 |
| 6,170,116 B1 | * | 1/2001 | Mizuta | 15/229.12 |
| 6,183,677 B1 | * | 2/2001 | Usui et al. | 264/131 |
| 6,280,529 B1 | * | 8/2001 | Meyer | 134/6 |
| 6,306,187 B1 | * | 10/2001 | Maeda et al. | 51/298 |
| 6,777,966 B1 | * | 8/2004 | Humphrey et al. | 324/757 |

FOREIGN PATENT DOCUMENTS

| | | | | |
|---|---|---|---|---|
| EP | 0 937 541 | | 8/1999 | B24B/9/00 |
| JP | 07244074 A | * | 9/1995 | G01R/1/073 |
| JP | 10019928 A | * | 1/1998 | G01R/1/06 |

* cited by examiner

*Primary Examiner*—David B. Thomas
(74) *Attorney, Agent, or Firm*—Drinker Biddle & Reath LLP

(57) ABSTRACT

A method and apparatus is provided for cleaning and shaping a probe tip using a multi-layer adhesive and abrasive pad. The multi-layer adhesive and abrasive pad is constructed on the surface of a support structure, such as a silicon wafer, and is made of an adhesive in contact with abrasive particles. Adhesive is applied in layers with abrasive particles in-between each layer of adhesive. Abrasive particles may vary in size and material from layer to layer to achieve cleaning, shaping and polishing objectives.

18 Claims, 4 Drawing Sheets

METHOD AND APPARATUS FOR PROBE TIP CLEANING AND SHAPING PAD

FIELD OF INVENTION

The present invention relates to a cleaning and shaping pad, and to a probe tip cleaning and shaping pad.

BACKGROUND OF THE INVENTION

In the field of semiconductor manufacturing, it is common practice to test the semiconductor chips at various stages in the manufacturing process. In particular, due to the time and expense required to package a semiconductor chip, and given the probability that a particular semiconductor chip may have a flaw, it is common practice to inspect the wafers before the wafers are cut up into individual chips. To facilitate this testing, small conductive pads (electrodes) are often located on the surface of the wafer that may be used to connect chip circuitry to an external tester such as a probe device. The probe device may send electrical signals through these electrodes to the circuitry on the wafer. The probe device may also receive electrical response signals from the wafer through these electrodes. These response signals can be processed to determine whether individual chips on the wafer are functioning properly. If a poor electrical connection is made between the probe device and the electrodes, an incorrect status for a chip may be obtained.

With reference to FIG. 1A, a probe device may include a probe card 105 which holds one or more probe needles 100. The probe needles 100 may be oriented in various configurations which are known in the art, such as a vertical paliney probe 120, a vertical P4 C-Probe 121, or a cantilevered probe 122 as shown in FIG. 1B. During testing of a wafer 125 having electrodes 130, probes 100 are brought into contact with electrodes 130 by positioning probe card 105 and wafer 125 relative to each other such that probes 100 contact electrodes 130.

Semiconductor geometry is constantly decreasing. For example, electrodes 130 may be 50 micrometers by 50 micrometers in size and the on-center distance between the pads, otherwise known as the pitch, may be approximately 75 micrometers In order to contact only one electrode at a time, a probe needle of a small diameter is desired. A typical probe needle may have a diameter D shown in FIG. 1C. The probe should be large enough in diameter to provide the mechanical stability and support necessary to keep the probe needle from bending. However, because of the small size of the pads, it is desirable that the end of the probe needle have a smaller diameter with a pointed or needle-like tip 150. Probe needles may be made of many different materials, as is known in the art, and in one embodiment may be made of tungsten. Other materials used for probe tips include nickel alloys, paliney, beryllium copper, tungsten-rhenium, palladium alloys, and other metal coated silicon probes.

With reference to FIG. 1A, electrode 130 of semiconductor device 125 may be formed of aluminum (Al) or other metallic materials known in the art, such as Aluminum-Silicon-Copper pads, Gold pads, and Lead/Tin bumps. An aluminum oxide layer, or other oxide layer, may have formed over the surface of electrode 130 during the wafer manufacturing process. Because aluminum oxide is an insulator, it may be necessary to scratch through the oxide layer so that a reliable contact is formed between the electrode and the probe tip. Scratching through the oxide layer may be accomplished by an overdrive process that includes bringing the semiconductor wafer electrode into contact with the probe tip and moving the wafer and/or the probe card such that the probe needle scrapes and digs into electrode 130.

The overdrive process may break through the oxide layer to make a good electrical connection with the electrode; however, with reference to FIG. 2, extraneous particles such as aluminum, aluminum oxide, silicon, and other types of particles, debris or foreign matter 205 may adhere to the surface of the probe tip. After repeated probing operation, the particles 205 on the probe tip may prevent a good conductive connection from forming with electrode 130 and the probe tip. The repeated probing process may also cause the tip of probe 100 to become blunted 210 as illustrated in FIG. 2. A blunt probe tip may make the probe tip less effective at scratching the surface of the electrode. A blunted probe tip may also cause probe marks to go beyond the specified allowable electrode contact area on the wafer if the blunt end of the tip becomes too large. A pointed probe tip has a smaller tip surface area at the end of the probe tip such that, for the same force, a higher pressure is applied on the aluminum oxide, providing for an enhanced ability to break through the aluminum oxide.

A further problem related to the blunting of a probe tip, is that uneven blunting of probe tips creates probes of different lengths which may cause planarity problems. Probes may wear unevenly because sometimes some of the probes may be probing portions of the wafer where no electrodes exist and the probes touch down on materials of different hardness than the electrode pad. Additionally, probe tips may have burrs that were formed when the probes were made or sharpened, or from adhered debris. Probes may also be uneven in length for other reasons. Regardless of the reason for the variability in the probe tip lengths, planarity problems decrease the ability of the probes to accurately find the target electrode pads. Some efforts to improve planarity involve the blunting of non-blunted probe tips to conform to the length of the already blunted tips. This, however, negatively impacts the performance of the probe cards in other areas as discussed herein.

In response to the problem of particles adhering to the probe needle, a number of techniques have been developed for cleaning probe tips. For example, FIG. 3 is a drawing from U.S. Pat. No. 6,170,116 showing a side view of an abrasive sheet 300 which is composed of a silicon rubber 302 which provides a matrix for abrasive particles 303, such as an artificial diamond powder. In FIG. 3, the probe 100 is inserted into the abrasive sheet 300, and some of the extraneous particles that adhere to the probe tip may be removed or scraped off by the abrasive particles 303. Unfortunately, this process may not remove all of the extraneous particles from the probe tip and may contaminate the probe tip with a viscous silicon rubber film or other particles which adhere to the tip as it is stuck into the silicon rubber matrix. To counteract this secondary particle contamination of the tip, the probe needle may be cleaned by spraying an organic solvent onto the tip of the needle, thereby dissolving and removing some of the viscous silicon rubber film and perhaps some of the secondary particles. Thereafter, the organic solvent may be blown off the probe tip in order to further prepare the tip. This process is time consuming and is performed off-line. Furthermore, the process may result in particles stuck to the tip and even introduce further contaminates.

Other wafer cleaning devices are disclosed such as a cleaning wafer with a mounted abrasive ceramic cleaning block which is rubbed against the probe needles as disclosed in U.S. Pat. No. 6,019,663; the use of a sputtering method to remove particles from the probe tip as disclosed in U.S. Pat. No. 5,998,986; the use of a rubber matrix with abrasive particles and a brush cleaner made of glass fibers as disclosed in U.S. Pat. No. 5,968,282; the employment of lateral vibrational movement against a cleaning surface for removing particles from a probe tip as disclosed in U.S. Pat. No. 5,961,728; spraying or dipping the probe needles in cleaning solution as disclosed in U.S. Pat. No. 5,814,158; and other various cleaning methods such as those disclosed in U.S. Pat. No. 5,778,485 and U.S. Pat. No. 5,652,428.

Many of these methods and devices interrupt the testing of wafers by use of off-line processing to clean the probe tips. Some of these methods introduce further contaminates to the probe tips. Some of these methods exacerbate the blunting of the probe tips. None of these methods address the shaping of probe tips while cleaning on-line.

Therefore, there is a need for an on-line method and apparatus to clean particles from probe tips without the use of solvents or blowing mechanisms. Furthermore, a need exists for a method and apparatus for cleaning probe tips that does not blunt the tip of the probes, but rather enhances the shape of the probe tip. Additionally, there exists a need for the ability to clean and shape the probe tips in a quick and consistent manner with minimal downtime. Furthermore, probe tip shaping extends the life of the probe needle. Probe tip shaping enhances the scratching ability, thereby enhancing the reliability of the electrical contact.

SUMMARY OF THE INVENTION

A method and apparatus is provided for cleaning and shaping a probe tip using a multi-layer adhesive and abrasive pad. The multi-layer adhesive and abrasive pad is constructed on the surface of a support structure, such as the surface of a silicon wafer, and is made of an adhesive in contact with abrasive particles. Adhesive is applied in layers with abrasive particles in-between each layer of adhesive. Abrasive particles may vary in size and material from layer to layer to achieve cleaning, shaping and polishing objectives.

BRIEF DESCRIPTION OF THE DRAWINGS

The subject invention will hereinafter be described in conjunction with the appended drawing figures, wherein like numerals denote like elements, and.

DETAILED DESCRIPTION OF EXEMPLARY EMBODIMENTS

The present invention may be described herein in terms of various hardware components and processing steps. It should be appreciated that such components may be realized by any number of hardware components configured to perform the specified functions. For example, the present invention may employ various integrated circuit components, e.g., transistors, memory elements, digital signal processing elements, integrators, motors, actuators, servos, gears, and the like, which may carry out a variety of functions under the control of one or more microprocessors or other control devices. Moreover, various types of material may be used in making the probe tip cleaning and shaping pads. In addition, those skilled in the art will appreciate that the present invention may be practiced in any number of probing device contexts and that the preferred embodiment described herein is merely one exemplary application for the invention. General techniques that may be known to those skilled in the art are not described in detail herein.

Figure 1A:
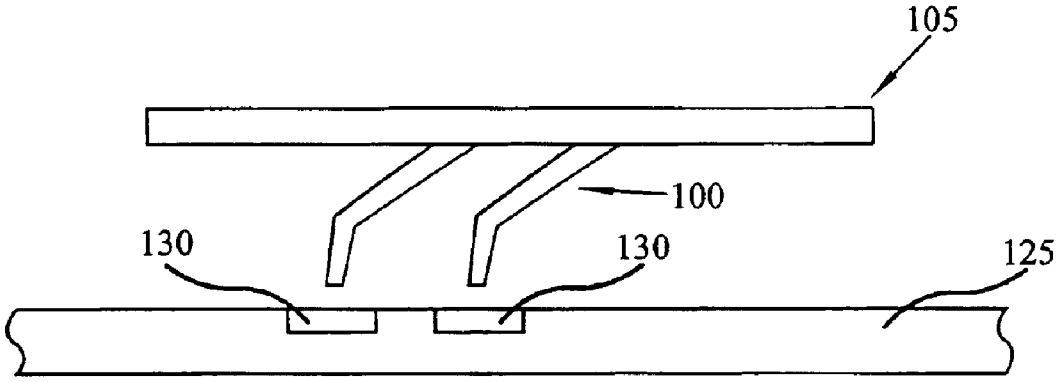
FIG. 1A illustrates an elevation view of a probe card with probe needles and a semiconductor wafer positioned for testing.
Figure 1B:
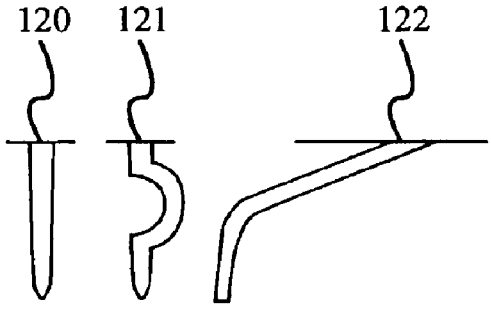
FIG. 1B illustrates various probe tip types.
Figure 1C:
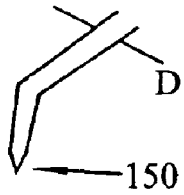
FIG. 1C is a detailed view of a probe tip in an exemplary embodiment.
Figure 2:
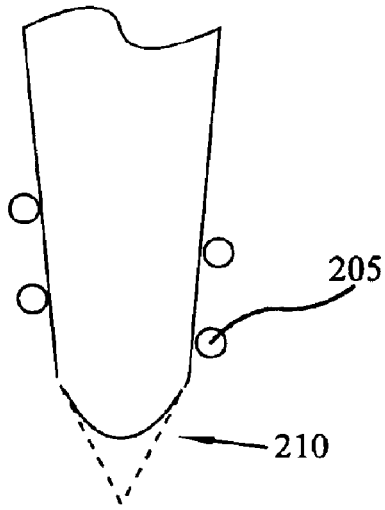
FIG. 2 is a more detailed view of a probe tip in an exemplary embodiment.
Figure 3:
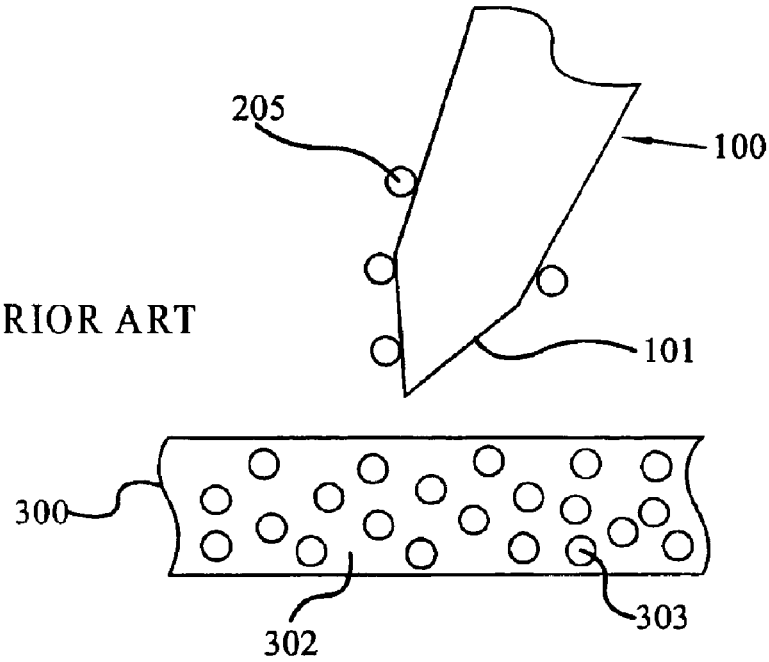
FIG. 3 PRIOR ART
FIG. 3 is an exemplary drawing in the prior art of probe tip cleaning.
Figure 4:
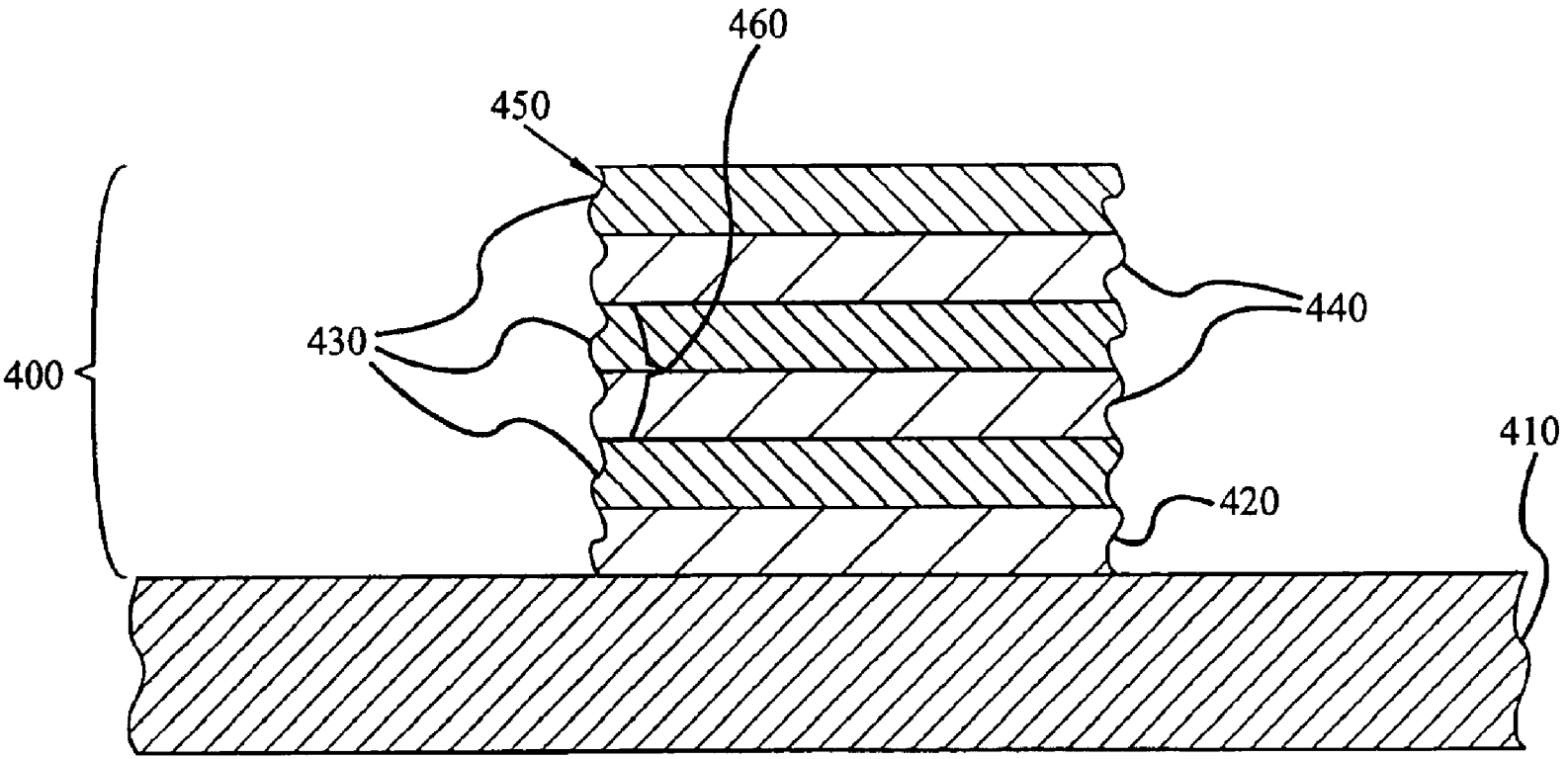
FIG. 4 illustrates an exemplary multi-layer adhesive and abrasive pad and pad support structure.

An exemplary Multilayer Adhesive and Abrasive Pad ("MAAP") 400 for cleaning and shaping probe tips is illustrated in FIG. 4 according to various aspects of the present invention. A support structure 410 supports MAAP 400. MAAP 400 is attached to support structure 410 by, for example, a first adhesive layer 420. MAAP 400 is made of abrasive particles and an adhesive material. According to an exemplary embodiment of the present invention, the diameter of the abrasive particles included in the pad (e.g., MAAP 400) are between 0.01 microns and 90 microns. MAAP 400 has a first adhesive layer 420 and successive layers of abrasive particles 430 and adhesive 440. Top layer 450 is an abrasive layer.

In one embodiment, support structure 410 is a semiconductor wafer which supports the probe tip cleaning and shaping pad 400. A silicon wafer may be a convenient choice of support structure because it is easily adaptable for use in the machines which test the semiconductor wafers. For example, with a silicon wafer support structure, it is possible to test one or more semiconductor wafers, or even to test a portion of a semiconductor wafer, and then remove the tested wafer and replace it with a semiconductor wafer supporting pad 400 for on-line cleaning and shaping of the probe tips. Alternatively, other support structures may be used such as flat disks made of stainless steels or ceramics or glass. Support structure 410 may have a thickness of 500 micrometers in one embodiment, and in other embodiments may be thinner or thicker as necessary. For example, the elastic modulus of a silicon wafer support structure is approximately $1.9\times10^{11}$ Pa, and for steels $2.1\times10^{11}$ Pa. Moreover, the flatness of the support structure is important, for example, to avoid planarity problems.

First adhesive layer 420 is attached to one surface of support structure 410. In accordance with one aspect of the present invention, first adhesive layer 420 may comprise a double stick tape to aid in the simple removal and replacement of MAAP 400. For example, when MAAP 400 needs replacing or is no longer needed, it can be peeled off of support structure 410. In other embodiments, a more permanent connection may be provided by using single or multiple layers of adhesive for first adhesive layer 420 without the double stick tape. Other layers of adhesive 440 may exist between successive layers of abrasive particles 430. Two or more layers of adhesive may make up first adhesive layer 420, and a single layer of adhesive may exist in the inter-layers. However, any number of layers may be applied to form the first adhesive layer 420 or to form adhesive layers 440 between abrasive particle layers 430 and between a layer 430 and top layer 450.

In one embodiment, the adhesive material may be an acrylic adhesive such as 3M F-9460PC available from 3M.

Alternatively, the adhesive material may be made of elastic, Teflon, polymer, epoxy, polyurethane or other materials exhibiting soft, pliable properties that are available or formable in thin sheet form. These products may be available through any number of suppliers, such as, 3M, Epoxy Technology, and Dexter. The thin layer of adhesive material may, for example, be approximately 50 micrometers in thickness, although thinner and thicker layers may be used.

In one embodiment, adhesive layer 440 may provide the minimum adhesive sufficient to hold the next layer of abrasive particles. Use of an adhesive, such as an acrylic adhesive, in multi-layer adhesive and abrasive pad 400 provides several advantages over a composite resin matrix suspending abrasive particles in a resin material. Top layer 450 of MAAP 400 may include abrasive particles which may make the adhesive material less likely to stick to the probe tip than the resin material in matrix type cleaning pads. MAAP 400 further may not require the extra cleaning steps often used in resin matrix devices. Also, MAAP 400 adhesive tends to be softer than resin which allows the insertion of probe tips 150 into MAAP 400 under less pressure than that typically required for resin pads, thus reducing the chances of bending the probes. Furthermore, the probe needles are less likely to get stuck in MAAP 400 than in resin pads which have been known to yank probes out of the head of the probe card. MAAP 400 has the further advantage of facilitating the piercing of the pad with the probe needles because the adhesive may not be as hard as resin pads. The adhesive in MAAP 400 also has a relatively short recovery time (compared to resin materials) allowing holes in the adhesive to reseal which may facilitate the cleaning of the probe tips, the capture of particles within the pad, and allow the reuse of areas of MAAP 400.

Abrasive layers 430 may be located between adhesive layers 420 and 440. Abrasive layers 430 may include top abrasive layer 450. The abrasive material in one embodiment may comprise diamond particle; for example, 15 micron and 16 micron SUN E8 diamond powder manufactured by Sun Marketing Group. Alternatively, other materials, such as aluminum oxide, zirconia, alumina-zirconia mixtures, tungsten carbide, silicon carbide, silicon nitride, and titanium carbide, may suitably be used for one or more of the abrasive particle layers. Furthermore, any material with a hardness higher than those of the probe materials might be used as abrasive particles in MAAP 400. For example, the abrasive particles might have a hardness that is harder than a Vickers hardness of approximately 1000 $kg/mm^2$.

Because different probes have different hardness values, the hardness of the abrasive materials used in different layers of MAAP 400 may vary between pads designed for probes made of different materials. As an example of probe hardness, Tungsten Rhenium is one of the hardest probes with a Hardness Value ("HV") of 650 $kg/mm^2$, paliney is in the range of 350–400 $kg/mm^2$, and Beryllium-Copper or Nickel alloy are in the range of 300–350 $kg/mm^2$.

As an example of foreign particle hardness, aluminum oxide has a HV of 1500 $kg/mm^2$, and copper oxide (cupric oxide) is much softer than aluminum oxide. As an example of abrasive particle hardness, diamond has a HV of 10,000 $kg/mm^2$, and silicon carbide is 2500–3500 $kg/mm^2$. Abrasive particles might also be selected or created to have other qualities such as high compressive and fracture strength. Abrasive particles might also be selected or created such that the abrasive particles are harder than the foreign particles and debris being removed from the probe tips. For example, diamond abrasive particles may be used to remove aluminum oxide. Abrasive particles might also be chosen based on their hardness and particle size and particle size distribution in removal of debris.

In accordance with another aspect of the present invention, the grit sizes of the abrasive material in inter-layers 430 and on surface layer 450 may be well defined. For example, all of the abrasive particle layers 430 and 450 may be selected to have the same grit size. In another example, the grit sizes and materials may vary from one layer to the next, such as where the largest grit is in surface layer 450 and the grit size becomes smaller with each successive layer 430 closer to support structure 410. In this example, the coarser grit material may provide better bulk shaping and cleaning, and the finer size grit may provide finer shaping, cleaning and polishing of the ends of the tip. Therefore, the finer grit may be placed in pad 400 so as to contact a specific portion of the probe nearest the tip. Polishing the probe tip makes it less likely that foreign particles will stick to the probe tip. Grit sizes and materials may be selected in reverse graduated order with the smallest grit on top layer 450 and larger grits as the layers get closer to support structure 410. The individual grit sizes for each layer may also be varied to achieve other shaping needs.

In a further example, the size of the grit of the abrasive material may be chosen based on the types of materials used in the probe tips. Exemplary probe tip materials include nickel alloys, paliney, Beryllium-Copper, tungsten, and other materials well known in the art of wafer testing. For example, tungsten rhenium probe tips are very strong and may require a coarser grit to achieve tip shaping in an efficient manner. In contrast, smaller grit sizes may be used for probe tips made of softer materials such as paliney, Beryllium-Copper, and Nickel. Also, the grit sizes may be chosen with regard to the strength of the probe needles so as not to bend the needles as they are inserted into pad 400. In another embodiment, grit sizes and materials may be chosen based upon their ability to remove specific types of foreign matter, debris and particulates adhering to the probe tips. Furthermore, in an exemplary embodiment, desired probe tip radius sizes may be a determining factor in choosing abrasive particle grit size. For example, larger grit sizes may result in a larger tip radius, and smaller grit sizes may result in a smaller tip radius.

The abrasive inter-layers may contain various types, sizes and quantities of abrasive material and types and quantities of adhesive material, and the layers may vary in thickness, for example, from 25 microns to 100 microns. In one embodiment, a stack of six layers of abrasive and adhesive material may be used for a typical MAAP 400 and pad 400 may have a total height of 25 mils (635 microns). In other embodiments, more or less layers of adhesive and abrasive may be used, and the total height of pad 400 may be selected such that it is thick enough for the insertion of a sufficient portion of the probe tip, for example 10 mils, such that probe tip 150 can be cleaned and shaped without contacting the support structure. While any number of layers may be chosen with varying thickness choices, the total thickness of pad 405 should be such that the probe tip may be inserted to a desired depth without the probe tip coming into contact with the support structure. For example, the thickness of the pad may range from 2 mils to 200 mils, and the number of abrasive layers may range from 1 to 100. In one embodiment, 6 layers of abrasive alternate with 6 layers of adhesive forming a 25 mils pad with an adhesive layer between each abrasive layer. In another embodiment, specific abrasive material and sizes may be used for shaping specific parts of probe tip 150. In this embodiment, it may be desirable to coordinate the vertical location of specific abrasive material layers with the penetration depth of probe tip 150.

An exemplary embodiment of a MAAP may be constructed in the following manner. A silicon wafer support structure is set on a hot chuck which is heated to approximately 120° F. A first adhesive layer 420 is applied to the surface of support structure 410. Adhesive layers 420 and 440 may be formed on support structure 410 or on abrasive layers 440 by using an adhesive attached to an applicator or "backing" layer. Layers of adhesive may be applied to the abrasive layer 430 or support structure 410 by pressing the adhesive holding backing layer onto the abrasive layer 430 or support structure 410 with the adhesive side of the backing facing toward the support structure. This may be done while heating the support structure and layers on the support structure. A roller or other device may be used to eliminate any air bubbles and to improve the planarity of the adhesive layer. Alternatively, the adhesive and backing can be rolled directly on to support structure 410 or abrasive layer 430. The backing material can then be peeled off exposing the thin layer of adhesive material. Alternatively, the adhesive material may be applied by any other known method, such as spraying or applying to a spinning wafer.

An abrasive layer 430 may be added by pouring or sprinkling the abrasive particles over the adhesive and optionally assisting the attachment of the particles to the adhesive by use of a brush or other tool. The remainder of the abrasive material that does not stick to the adhesive may be dumped, blown, or brushed away to prepare the MAAP for another layer of adhesive. Any other method of putting the abrasive particles in contact with the adhesive may be used.

In one embodiment, each layer of adhesive 440 and of abrasive 430 can be treated as separate layers because they may be applied as such. However, some intermixing of adhesive and abrasive occurs as the abrasive sticks to the adhesive. Therefore, in another embodiment, adjacent abrasive and adhesive layers may be considered a composite layer 460. As discussed above, pad 405 may be made such that one composite layer 460 has a different abrasive particle grit size or material from another composite layer 460.

The MAAP described herein may be used by any probe type, such as, vertical probes and cantilever probes. Probes may require cleaning at varying intervals, for example, after a specified number of wafer tests. The intervals might be different due to the type of probe material, the material used on the probe pad, or other factors. MAAP 400 may be used by bringing the probe tip 150 in contact with MAAP 400, and overdriving probe tip 150 into MAAP 400 a sufficient distance to both shape and clean probe tip 150. For example, in one embodiment, probe tip 150 may be driven in a distance of 10 mils into a 25 mils stack. Probe tip 150 is then withdrawn from MAAP 400. One iteration of this process is called a touchdown and multiple touchdowns may be used for probe tip cleaning and shaping. For example, to clean a probe tip, 10 touchdowns might be used, although any number of touchdowns may be selected to achieve the desired cleaning, depending on a variety of factors. The number of touch downs may, for example, range from 1 to 21,000. Furthermore, when shaping the tip, in one embodiment, 20,000 touchdowns may be used to achieve tip shaping of, for example, tungsten under 6–7 mil overdrive, and 10,000 touchdowns may be used for vertical paliney probes under 10 mil overdrive. The number of touchdowns may depend on the initial probe diameter and tip diameters, and the final desired condition. Of course, a point of diminishing returns exists where further touchdowns provide minimal improvement in the tip shaping.

Figure 5:
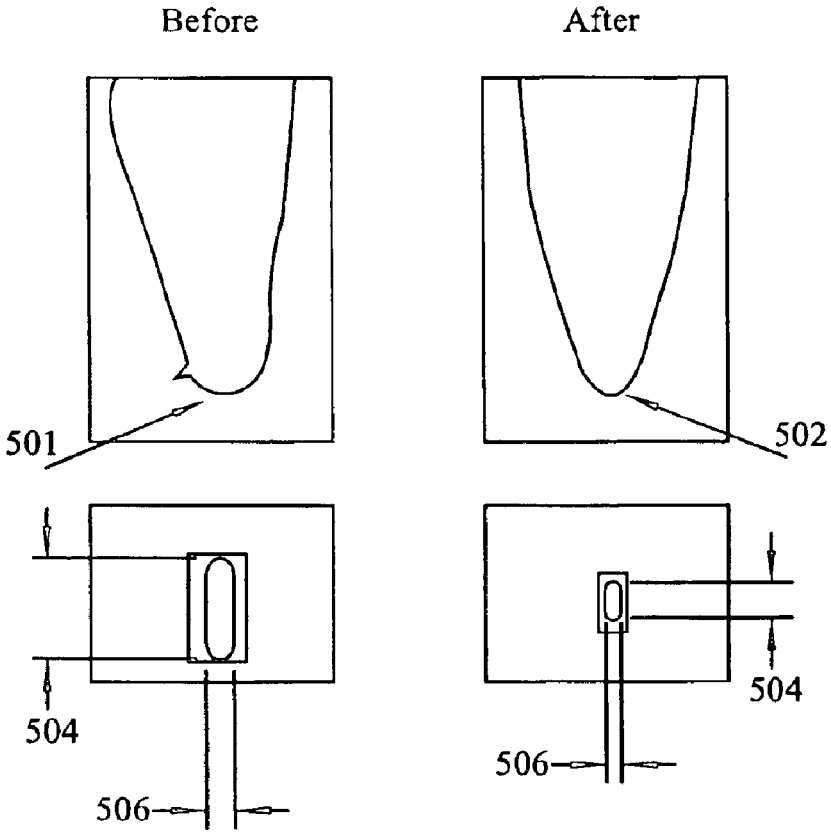
FIG. 5 illustrates sample test results showing exemplary benefits obtained through use of a multi-layer adhesive and abrasive pad.

FIG. 5 shows a probe tip shaping test conducted on a 25 mil thick multi-layer abrasive pad (MAAP) with 15 micron abrasive powder. The test was conducted on an assembly test card with a contact set, where the tips overdrive 5 mils into 25 mil MAAP. A test time was set at 250 msec per touchdown, and initial measurements were made of the contact force, tip radius, tip contact length and tip contact width. After 10,000 touchdowns on the MAAP, the tips were measured and inspected. Next, another 10,000 touchdowns were performed on the MAAP, and another 1,000 touchdowns were performed on a 6 micron particle size MAAP for final polishing. Next, the tips were measured and inspected again. As can be observed from FIG. 5A, the probe tips before tip shaping were rounded and blunt 501 compared to the probe tips 502 after tip shaping which exhibit more sharp and uniform features. Furthermore, the tip contact length 504 and tip contact width 506 are narrowed and shortened through the process of performing the 10,000 and 21,000 touchdowns.

The probe tips are dramatically improved in terms of the sharpness of the tip and the ability for the probe tips to be directed to smaller targets and thus improved. Furthermore, the sharp probe tips are better able to scratch the surface of those targets and develop proper electrical contacts. In addition, in the process of the probe tip shaping, the tips are cleaned of any debris which may have accumulated from contacting the bond pads or from other contact with other portions of the semiconductor wafer.

Although others have attempted probe tip shaping and cleaning, their attempts have several serious drawbacks or disadvantages. MAAP 400 has the advantage of allowing probes to be inserted in cleaning and shaping pad 400 with a relatively low amount of force. Using less force reduces the risk of bending or breaking the probe needles and is beneficial to the probe tip life by reducing the repetitive high stress on probe tip 150. For example, in tests, some resin type probe tip conditioners used as much as 28 grams of force to insert a probe tip 8 mils into the material. In contrast, MAAP 400 only used one tenth of a gram to insert the same probe tip to the same depth.

MAAP 400 also exhibits a dramatic improvement (decrease) in the size of the tip radius when compared to other probe tip conditioners. For example, one resin type probe tip conditioner produced a probe tip radius of 0.000767 inches. In contrast, MAAP 400 produced a probe tip radius of 0.000226 inches. Regardless of the insertion force or probe tip radius, prior art probe tip conditioners generally require further cleaning steps. In contrast, the MAAP probe tips did not require further cleaning steps before resuming testing of wafers. Therefore, a considerable saving of time and money may be possible using an MAAP.

It has been noted through tests that the symmetry of the probe tip is improved and is desirable over that of probe tips created by other methods, including probe tips machined by laser. The probe tips are sharper, clean, and polished. This method may also be used in the process of creating new probe tips. Furthermore, the ability to sharpen probe tips which have become blunt allows the same probe card to be used for an extended period of time, thus improving the probe card life and reducing the downtime involved when an old probe card is switched out for a new probe card. Similarly, the cost of getting the probe card retrofitted or reconditioned is completely avoided or delayed.

Use of MAAP 400 further has been found to improve the planarity of the probe tips by removing burrs, and shaping the probe tips. Longer probe tips come into contact with more abrasive particles than shorter probe tips Thus the longer probe tips are shaped more aggressively than the shorter probe tips, bringing the longer probe tips further into planarity with the other tips. Importantly, the planarity of the probe tips is not achieved by blunting the good probe tips to make them match the other poor probe tips, but by shaping up all the probe tips.

In addition, the use of MAAP 400 to clean probe tips 150 provides an efficient method which does not require other processing steps such as brushing or blowing off particles, or the use of any solvents to dissolve particles. While MAAP 400 could be used off line, the method may be conducted on-line, further reducing the impact of probe tip cleaning and shaping on the throughput of the wafer testing process. Therefore, the multi-layer adhesive and abrasive pad 400 discussed herein may enable new probing technologies and allow for even smaller topographies in the semiconductor manufacturing process.

The present invention has been described above with reference to an exemplary embodiment. However, those skilled in the art will recognize that changes and modifications may be made to the exemplary embodiment without departing from the scope of the present invention. For example, the various components of the probe tip cleaning and shaping pad may be implemented in alternate ways depending upon the particular application or in consideration of any number of cost functions associated with the operation of the system, e.g., the layers may be made of different materials with similar characteristics to those described herein and the dimensions may be varied for the size of the pad, size of the particles, or thickness of layers. In addition, the techniques described herein may be extended or modified for use with various other applications, such as, for example, pogo pins for testers, sockets and head pins in package test, and connectors in the auto industry. These and other changes or modifications are intended to be included within the scope of the present invention.

What is claimed is:

1. An apparatus for cleaning and shaping a probe tip comprising:

a support structure having a surface; and a pad formed on said surface of said support structure, wherein said pad comprises a plurality of alternating layers of an adhesive layer and an abrasive layer, said plurality of alternating layers including at least two abrasive layers;

wherein each of said adhesive layer includes an adhesive and each of said abrasive layer includes a plurality of abrasive particles.

2. The apparatus of claim 1 wherein at least one of said abrasive layers comprises abrasive particles of a different size than the abrasive particles of another abrasive layer.

3. The apparatus of claim 2 wherein the size of the abrasive particles increases for each abrasive layer that is further from the support structure.

4. An apparatus for cleaning and shaping a probe tip comprising:

a support structure having a surface;

a pad formed on said surface of said support structure, wherein said pad comprises a plurality of composite layers, each of said composite layers including an adhesive and a plurality of abrasive particles in contact with said adhesive.

5. The apparatus of claim 4 wherein at least one of said composite layers comprises abrasive particles of a different size than the abrasive particles of another of said composite layers.

6. The apparatus of claim 5 wherein the size of said abrasive particles increases for each of said composite layers that is further from the support structure.

7. The apparatus of claim 4 wherein at least one of said composite layers comprises abrasive particles of a different material than the abrasive particles of another composite layer.

8. The apparatus of claim 4 wherein the support structure is a semiconductor wafer, wherein the adhesive is an acrylic adhesive, and wherein the abrasive particles are diamond particles.

9. A method for cleaning and shaping a probe tip comprising the steps of: inserting the probe tip into a multi-layered adhesive and abrasive particle pad, said pad including a plurality of abrasive layers including abrasive particles, said abrasive layers being separated by an adhesive material; and extracting the probe tip.

10. The method of claim 9 wherein the step of inserting the probe tip comprises inserting the probe tip a predetermined distance into the pad, wherein said predetermined distance is a function of tip length and pad thickness.

11. The method of claim 9 wherein the steps of inserting and extracting are performed on-line.

12. The method of claim 9 wherein at least one of said abrasive layers has abrasive particles having a different size than the abrasive particles of at least one other abrasive layer.

13. The method of claim 9 wherein at least one of said abrasive layers is a composite layers including an adhesive and abrasive particles having a different size than the abrasive particles of at least one other abrasive layer.

14. A method of making a probe tip cleaning and shaping pad comprising the steps of:

applying an adhesive layer to a support structure;

applying a plurality of abrasive particles to said adhesive layer to form an abrasive particle layer; and heating the support structure, wherein the step of applying said adhesive layer further comprises rolling the adhesive layer with a rolling tool to remove air bubbles; and wherein the step of applying the plurality of abrasive particles comprises brushing the plurality of abrasive particles on to said adhesive layer.

15. A method of making a probe tip cleaning and shaping pad comprising the steps of:

applying an adhesive layer to a support structure;

applying a plurality of abrasive particles to said adhesive layer to form an abrasive particle layer; and heating the support structure, wherein the step of applying an adhesive layer further comprises placing the adhesive layer on the support structure and rolling over the adhesive layer with a rolling tool to remove air bubbles; and wherein the step of applying the plurality of abrasive particles comprises brushing of abrasive particles on to said adhesive layer.

16. The method of claim 14 wherein in the step of applying the plurality of abrasive particles, said plurality of abrasive particles comprises varying grit sizes for different layers; and wherein said abrasive particles comprise diamond particles.

17. The method of claim 16 wherein the step of applying the plurality of abrasive particles further comprises graduating the size of the abrasive particles from smallest to largest with increasing distance of layers from the support structure.

18. The method of claim 17 wherein the step of applying the adhesive layer further comprises using an adhesive backing layer that can be peeled off, leaving the adhesive behind.

* * * * *